US010446086B2

(12) United States Patent
Chaji

(10) Patent No.: US 10,446,086 B2
(45) **Date of Patent: *Oct. 15, 2019**

(54) SYSTEMS AND METHODS OF MULTIPLE COLOR DRIVING

(71) Applicant: Ignis Innovation Inc., Waterloo (CA)

(72) Inventor: Gholamreza Chaji, Waterloo (CA)

(73) Assignee: Ignis Innovation Inc., Waterloo (CA)

( * ) Notice: Subject to any disclaimer, the term of this patent is extended or adjusted under 35 U.S.C. 154(b) by 0 days.

This patent is subject to a terminal disclaimer.

(21) Appl. No.: 16/140,899

(22) Filed: Sep. 25, 2018

(65) Prior Publication Data

US 2019/0027098 A1 Jan. 24, 2019

Related U.S. Application Data

(63) Continuation of application No. 15/293,526, filed on Oct. 14, 2016, now Pat. No. 10,102,808.

(30) Foreign Application Priority Data

Oct. 14, 2015 (CA) ..... 2908285

(51) Int. Cl.
*G09G 3/20* (2006.01)
*G09G 3/3291* (2016.01)

(52) U.S. Cl.
CPC ..... *G09G 3/3291* (2013.01); *G09G 3/2003* (2013.01); *G09G 2300/0443* (2013.01); *G09G 2300/0452* (2013.01); *G09G 2310/027* (2013.01); *G09G 2310/0286* (2013.01); *G09G 2310/0291* (2013.01); *G09G 2310/08* (2013.01); *G09G 2330/021* (2013.01)

(58) Field of Classification Search
None
See application file for complete search history.

(56) References Cited

U.S. PATENT DOCUMENTS 3,506,851 A 4/1970 Polkinghorn
3,750,987 A 8/1973 Gobel
(Continued)

FOREIGN PATENT DOCUMENTS

AU 729652 6/1997
AU 764896 12/2001
(Continued)

OTHER PUBLICATIONS

Ahnood et al.: "Effect of threshold voltage instability on field effect mobility in thin film transistors deduced from constant current measurements"; dated Aug. 2009.
(Continued)

*Primary Examiner* — Kent W Chang
*Assistant Examiner* — Benjamin Morales
(74) *Attorney, Agent, or Firm* — Stratford Managers Corporation

(57) ABSTRACT

Systems and methods of color data driving for light emissive visual display technology, and particularly to systems and methods for driving pixels with more than three primary color subpixels. Only a subset of the total number of subpixels per pixel are driven at any one time reducing the number of decoders/DACs. The decoders/DACs are coupled by a color decoder only to the active subpixels using a switching fabric.

24 Claims, 4 Drawing Sheets

(56) References Cited

U.S. PATENT DOCUMENTS 3,774,055 A 11/1973 Bapat
4,090,096 A 5/1978 Nagami
4,354,162 A 10/1982 Wright
4,996,523 A 2/1991 Bell
5,122,733 A * 6/1992 Havel ..... G01R 13/02 324/114
5,134,387 A 7/1992 Smith
5,153,420 A 10/1992 Hack
5,170,158 A 12/1992 Shinya
5,204,661 A 4/1993 Hack
5,266,515 A 11/1993 Robb
5,278,542 A 1/1994 Smith
5,408,267 A 4/1995 Main
5,498,880 A 3/1996 Lee
5,572,444 A 11/1996 Lentz
5,589,847 A 12/1996 Lewis
5,619,033 A 4/1997 Weisfield
5,648,276 A 7/1997 Hara
5,670,973 A 9/1997 Bassetti
5,691,783 A 11/1997 Numao
5,701,505 A 12/1997 Yamashita
5,714,968 A 2/1998 Ikeda
5,744,824 A 4/1998 Kousai
5,745,660 A 4/1998 Kolpatzik
5,748,160 A 5/1998 Shieh
5,758,129 A 5/1998 Gray
5,835,376 A 11/1998 Smith
5,870,071 A 2/1999 Kawahata
5,874,803 A 2/1999 Garbuzov
5,880,582 A 3/1999 Sawada
5,903,248 A 5/1999 Irwin
5,917,280 A 6/1999 Burrows
5,949,398 A 9/1999 Kim
5,952,789 A 9/1999 Stewart
5,990,629 A 11/1999 Yamada
6,023,259 A 2/2000 Howard
6,069,365 A 5/2000 Chow
6,091,203 A 7/2000 Kawashima
6,097,360 A 8/2000 Holloman
6,100,868 A 8/2000 Lee
6,144,222 A 11/2000 Ho
6,229,506 B1 5/2001 Dawson
6,229,508 B1 5/2001 Kane
6,246,180 B1 6/2001 Nishigaki
6,252,248 B1 6/2001 Sano
6,268,841 B1 7/2001 Cairns
6,288,696 B1 9/2001 Holloman
6,307,322 B1 10/2001 Dawson
6,310,962 B1 10/2001 Chung
6,323,631 B1 11/2001 Juang
6,333,729 B1 12/2001 Ha
6,384,804 B1 5/2002 Dodabalapur
6,388,653 B1 5/2002 Goto
6,392,617 B1 5/2002 Gleason
6,396,469 B1 5/2002 Miwa
6,414,661 B1 7/2002 Shen
6,417,825 B1 7/2002 Stewart
6,430,496 B1 8/2002 Smith
6,433,488 B1 8/2002 Bu
6,473,065 B1 10/2002 Fan
6,475,845 B2 11/2002 Kimura
6,501,098 B2 12/2002 Yamazaki
6,501,466 B1 12/2002 Yamagashi
6,522,315 B2 2/2003 Ozawa
6,535,185 B2 3/2003 Kim
6,542,138 B1 4/2003 Shannon
6,559,839 B1 5/2003 Ueno
6,580,408 B1 6/2003 Bae
6,583,398 B2 6/2003 Harkin
6,618,030 B2 9/2003 Kane
6,639,244 B1 10/2003 Yamazaki
6,680,580 B1 1/2004 Sung
6,686,699 B2 2/2004 Yumoto
6,690,000 B1 2/2004 Muramatsu
6,693,610 B2 2/2004 Shannon
6,694,248 B2 2/2004 Smith
6,697,057 B2 2/2004 Koyama
6,724,151 B2 4/2004 Yoo
6,734,636 B2 5/2004 Sanford
6,734,837 B1 5/2004 Havel
6,753,655 B2 6/2004 Shih
6,753,834 B2 6/2004 Mikami
6,756,741 B2 6/2004 Li
6,756,958 B2 6/2004 Furuhashi
6,756,985 B1 6/2004 Hirotsune
6,777,888 B2 8/2004 Kondo
6,781,567 B2 8/2004 Kimura
6,788,231 B1 9/2004 Hsueh
6,809,706 B2 10/2004 Shimoda
6,828,950 B2 12/2004 Koyama
6,858,991 B2 2/2005 Miyazawa
6,859,193 B1 2/2005 Yumoto
6,876,346 B2 4/2005 Anzai
6,900,485 B2 5/2005 Lee
6,903,734 B2 6/2005 Eu
6,911,960 B1 6/2005 Yokoyama
6,911,964 B2 6/2005 Lee
6,914,448 B2 7/2005 Jinno
6,919,871 B2 7/2005 Kwon
6,924,602 B2 8/2005 Komiya
6,937,220 B2 8/2005 Kitaura
6,940,214 B1 9/2005 Komiya
6,954,194 B2 10/2005 Matsumoto
6,970,149 B2 11/2005 Chung
6,975,142 B2 12/2005 Azami
6,975,332 B2 12/2005 Arnold
6,995,519 B2 2/2006 Arnold
7,027,015 B2 4/2006 Booth, Jr.
7,034,793 B2 4/2006 Sekiya
7,038,392 B2 5/2006 Libsch
7,057,588 B2 6/2006 Asano
7,061,451 B2 6/2006 Kimura
7,071,932 B2 7/2006 Libsch
7,106,285 B2 9/2006 Naugler
7,112,820 B2 9/2006 Chang
7,113,864 B2 9/2006 Smith
7,122,835 B1 10/2006 Ikeda
7,129,914 B2 10/2006 Knapp
7,164,417 B2 1/2007 Cok
7,224,332 B2 5/2007 Cok
7,248,236 B2 7/2007 Nathan
7,259,737 B2 8/2007 Ono
7,262,753 B2 8/2007 Tanghe
7,274,363 B2 9/2007 Ishizuka
7,310,092 B2 12/2007 Imamura
7,315,295 B2 1/2008 Kimura
7,317,434 B2 1/2008 Lan
7,321,348 B2 1/2008 Cok
7,327,357 B2 2/2008 Jeong
7,333,077 B2 2/2008 Koyama
7,343,243 B2 3/2008 Smith
7,414,600 B2 8/2008 Nathan
7,466,166 B2 12/2008 Date
7,495,501 B2 2/2009 Iwabuchi
7,502,000 B2 3/2009 Yuki
7,515,124 B2 4/2009 Yaguma
7,535,449 B2 5/2009 Miyazawa
7,554,512 B2 6/2009 Steer
7,569,849 B2 8/2009 Nathan
7,595,776 B2 9/2009 Hashimoto
7,604,718 B2 10/2009 Zhang
7,609,239 B2 10/2009 Chang
7,612,745 B2 11/2009 Yumoto
7,619,594 B2 11/2009 Hu
7,619,597 B2 11/2009 Nathan
7,639,211 B2 12/2009 Miyazawa
7,683,899 B2 3/2010 Hirakata
7,688,289 B2 3/2010 Abe
7,760,162 B2 7/2010 Miyazawa
7,808,008 B2 10/2010 Miyake
7,859,520 B2 12/2010 Kimura
7,889,159 B2 2/2011 Nathan
7,903,127 B2 3/2011 Kwon
7,920,116 B2 4/2011 Woo

(56) References Cited

U.S. PATENT DOCUMENTS 7,944,414 B2 5/2011 Shirasaki
7,978,170 B2 7/2011 Park
7,989,392 B2 8/2011 Crockett
7,995,008 B2 8/2011 Miwa
8,063,852 B2 11/2011 Kwak
8,102,343 B2 1/2012 Yatabe
8,144,081 B2 3/2012 Miyazawa
8,159,007 B2 4/2012 Barna
8,242,979 B2 8/2012 Anzai
8,253,665 B2 8/2012 Nathan
8,283,967 B2 10/2012 Chaji
8,319,712 B2 11/2012 Nathan
8,564,513 B2 10/2013 Nathan
8,872,739 B2 10/2014 Kimura
9,171,491 B1 10/2015 Kwon
9,336,717 B2 5/2016 Chaji
9,430,958 B2 8/2016 Chaji
9,466,240 B2 10/2016 Jaffari
9,472,138 B2 10/2016 Nathan
9,659,527 B2 5/2017 Williams
9,685,114 B2 7/2017 Chaji
9,697,771 B2 7/2017 Azizi
9,721,505 B2 8/2017 Chaji
9,741,292 B2 8/2017 Nathan
9,747,834 B2 8/2017 Chaji
RE46,561 E 9/2017 Chaji
2001/0002703 A1 6/2001 Koyama
2001/0009283 A1 7/2001 Arao
2001/0024186 A1 9/2001 Kane
2001/0026257 A1 10/2001 Kimura
2001/0030323 A1 10/2001 Ikeda
2001/0035863 A1 11/2001 Kimura
2001/0040541 A1 11/2001 Yoneda
2001/0043173 A1 11/2001 Troutman
2001/0045929 A1 11/2001 Prache
2001/0052940 A1 12/2001 Hagihara
2002/0000576 A1 1/2002 Inukai
2002/0011796 A1 1/2002 Koyama
2002/0011799 A1 1/2002 Kimura
2002/0012057 A1 1/2002 Kimura
2002/0030190 A1 3/2002 Ohtani
2002/0047565 A1 4/2002 Nara
2002/0052086 A1 5/2002 Maeda
2002/0080108 A1 6/2002 Wang
2002/0084463 A1 7/2002 Sanford
2002/0101172 A1 8/2002 Bu
2002/0117722 A1 8/2002 Osada
2002/0140712 A1 10/2002 Ouchi
2002/0158587 A1 10/2002 Komiya
2002/0158666 A1 10/2002 Azami
2002/0158823 A1 10/2002 Zavracky
2002/0171613 A1 11/2002 Goto
2002/0181276 A1 12/2002 Yamazaki
2002/0186214 A1 12/2002 Siwinski
2002/0190971 A1 12/2002 Nakamura
2002/0195967 A1 12/2002 Kim
2002/0195968 A1 12/2002 Sanford
2002/0196213 A1 12/2002 Akimoto
2003/0001828 A1 1/2003 Asano
2003/0001858 A1 1/2003 Jack
2003/0016190 A1 1/2003 Kondo
2003/0020413 A1 1/2003 Oomura
2003/0030603 A1 2/2003 Shimoda
2003/0062524 A1 4/2003 Kimura
2003/0062844 A1 4/2003 Miyazawa
2003/0076048 A1 4/2003 Rutherford
2003/0090445 A1 5/2003 Chen
2003/0090447 A1 5/2003 Kimura
2003/0090481 A1 5/2003 Kimura
2003/0095087 A1 5/2003 Libsch
2003/0098829 A1 5/2003 Chen
2003/0107560 A1 6/2003 Yumoto
2003/0107561 A1 6/2003 Uchino
2003/0111966 A1 6/2003 Mikami
2003/0112205 A1 6/2003 Yamada
2003/0112208 A1 6/2003 Okabe
2003/0117348 A1 6/2003 Knapp
2003/0122474 A1 7/2003 Lee
2003/0122747 A1 7/2003 Shannon
2003/0128199 A1 7/2003 Kimura
2003/0151569 A1 8/2003 Lee
2003/0156104 A1 8/2003 Morita
2003/0169241 A1 9/2003 LeChevalier
2003/0169247 A1 9/2003 Kawabe
2003/0174152 A1 9/2003 Noguchi
2003/0179626 A1 9/2003 Sanford
2003/0185438 A1 10/2003 Osawa
2003/0189535 A1 10/2003 Matsumoto
2003/0197663 A1 10/2003 Lee
2003/0214465 A1 11/2003 Kimura
2003/0227262 A1 12/2003 Kwon
2003/0230141 A1 12/2003 Gilmour
2003/0230980 A1 12/2003 Forrest
2004/0004589 A1 1/2004 Shih
2004/0032382 A1 2/2004 Cok
2004/0041750 A1 3/2004 Abe
2004/0066357 A1 4/2004 Kawasaki
2004/0070557 A1 4/2004 Asano
2004/0070558 A1 4/2004 Cok
2004/0090186 A1 5/2004 Yoshida
2004/0095338 A1 5/2004 Miyazawa
2004/0129933 A1 7/2004 Nathan
2004/0130516 A1 7/2004 Nathan
2004/0135749 A1 7/2004 Kondakov
2004/0145547 A1 7/2004 Oh
2004/0150595 A1 8/2004 Kasai
2004/0155841 A1 8/2004 Kasai
2004/0160516 A1 8/2004 Ford
2004/0171619 A1 9/2004 Barkoczy
2004/0174349 A1 9/2004 Libsch
2004/0174354 A1 9/2004 Ono
2004/0183759 A1 9/2004 Stevenson
2004/0189627 A1 9/2004 Shirasaki
2004/0196275 A1 10/2004 Hattori
2004/0227697 A1 11/2004 Mori
2004/0239696 A1 12/2004 Masashi
2004/0251844 A1 12/2004 Hashido
2004/0252085 A1 12/2004 Miyagawa
2004/0252089 A1 12/2004 Ono
2004/0256617 A1 12/2004 Yamada
2004/0257353 A1 12/2004 Imamura
2004/0257355 A1 12/2004 Naugler
2004/0263437 A1 12/2004 Hattori
2005/0007357 A1 1/2005 Yamashita
2005/0052379 A1 3/2005 Waterman
2005/0057459 A1 3/2005 Miyazawa
2005/0067970 A1 3/2005 Libsch
2005/0067971 A1 3/2005 Kane
2005/0083270 A1 4/2005 Miyazawa
2005/0104842 A1* 5/2005 Baik ..... G06T 5/008
345/102
2005/0110420 A1 5/2005 Arnold
2005/0110727 A1 5/2005 Shin
2005/0123193 A1 6/2005 Lamberg
2005/0140600 A1 6/2005 Kim
2005/0140610 A1 6/2005 Smith
2005/0145891 A1 7/2005 Abe
2005/0156831 A1 7/2005 Yamazaki
2005/0168416 A1 8/2005 Hashimoto
2005/0206590 A1 9/2005 Sasaki
2005/0212787 A1 9/2005 Noguchi
2005/0219188 A1 10/2005 Kawabe
2005/0243037 A1 11/2005 Eom
2005/0248515 A1 11/2005 Naugler
2005/0258867 A1 11/2005 Miyazawa
2005/0285822 A1 12/2005 Reddy
2005/0285825 A1 12/2005 Eom
2006/0012311 A1 1/2006 Ogawa
2006/0022305 A1 2/2006 Yamashita
2006/0038750 A1 2/2006 Inoue
2006/0038758 A1 2/2006 Routley
2006/0038762 A1 2/2006 Chou
2006/0066533 A1 3/2006 Sato
2006/0077077 A1 4/2006 Kwon

(56) References Cited

U.S. PATENT DOCUMENTS

2006/0077134 A1 4/2006 Hector
2006/0077194 A1 4/2006 Jeong
2006/0092185 A1 5/2006 Jo
2006/0114196 A1 6/2006 Shin
2006/0125408 A1 6/2006 Nathan
2006/0125740 A1 6/2006 Shirasaki
2006/0139253 A1 6/2006 Choi
2006/0145964 A1 7/2006 Park
2006/0158402 A1 7/2006 Nathan
2006/0191178 A1 8/2006 Sempel
2006/0208971 A1 9/2006 Deane
2006/0209012 A1 9/2006 Hagood, IV
2006/0214888 A1 9/2006 Schneider
2006/0221009 A1 10/2006 Miwa
2006/0227082 A1 10/2006 Ogata
2006/0232522 A1 10/2006 Roy
2006/0244391 A1 11/2006 Shishido
2006/0244697 A1 11/2006 Lee
2006/0256053 A1 11/2006 Baek
2006/0261841 A1 11/2006 Fish
2006/0279478 A1 12/2006 Ikegami
2006/0290614 A1 12/2006 Nathan
2007/0001939 A1 1/2007 Hashimoto
2007/0001945 A1 1/2007 Yoshida
2007/0008251 A1 1/2007 Kohno
2007/0008297 A1 1/2007 Bassetti
2007/0035489 A1 2/2007 Lee
2007/0035707 A1 2/2007 Margulis
2007/0040773 A1 2/2007 Lee
2007/0040782 A1 2/2007 Woo
2007/0057873 A1 3/2007 Uchino
2007/0057874 A1 3/2007 Le Roy
2007/0063932 A1 3/2007 Nathan
2007/0075957 A1 4/2007 Chen
2007/0080908 A1 4/2007 Nathan
2007/0085801 A1 4/2007 Park
2007/0109232 A1 5/2007 Yamamoto
2007/0128583 A1 6/2007 Miyazawa
2007/0164941 A1 7/2007 Park
2007/0171218 A1* 7/2007 Hong ..... G09G 3/3406 345/211
2007/0182671 A1 8/2007 Nathan
2007/0236430 A1 10/2007 Fish
2007/0236440 A1 10/2007 Wacyk
2007/0241999 A1 10/2007 Lin
2007/0242008 A1 10/2007 Cummings
2008/0001544 A1 1/2008 Murakami
2008/0043044 A1 2/2008 Woo
2008/0048951 A1 2/2008 Naugler
2008/0055134 A1 3/2008 Li
2008/0062106 A1 3/2008 Tseng
2008/0074360 A1 3/2008 Lu
2008/0088549 A1 4/2008 Nathan
2008/0094426 A1 4/2008 Kimpe
2008/0111766 A1 5/2008 Uchino
2008/0122819 A1 5/2008 Cho
2008/0129906 A1 6/2008 Lin
2008/0198103 A1 8/2008 Toyomura
2008/0219232 A1 9/2008 Heubel
2008/0228562 A1 9/2008 Smith
2008/0231625 A1* 9/2008 Minami ..... G09G 3/3233 345/212
2008/0231641 A1 9/2008 Miyashita
2008/0265786 A1 10/2008 Koyama
2008/0290805 A1 11/2008 Yamada
2009/0009459 A1 1/2009 Miyashita
2009/0015532 A1 1/2009 Katayama
2009/0058789 A1 3/2009 Hung
2009/0121988 A1 5/2009 Amo
2009/0146926 A1 6/2009 Sung
2009/0153448 A1 6/2009 Tomida
2009/0153459 A9 6/2009 Han
2009/0174628 A1 7/2009 Wang
2009/0201230 A1 8/2009 Smith
2009/0201281 A1 8/2009 Routley
2009/0206764 A1 8/2009 Schemmann
2009/0225011 A1 9/2009 Choi
2009/0244046 A1 10/2009 Seto
2009/0251486 A1 10/2009 Sakakibara
2009/0278777 A1 11/2009 Wang
2009/0289964 A1 11/2009 Miyachi
2009/0295423 A1 12/2009 Levey
2010/0026725 A1 2/2010 Smith
2010/0033469 A1 2/2010 Nathan
2010/0039451 A1 2/2010 Jung
2010/0039453 A1 2/2010 Nathan
2010/0039458 A1 2/2010 Nathan
2010/0045646 A1 2/2010 Kishi
2010/0079419 A1 4/2010 Shibusawa
2010/0134475 A1 6/2010 Ogura
2010/0141564 A1 6/2010 Choi
2010/0141626 A1 6/2010 Tomida
2010/0207920 A1 8/2010 Chaji
2010/0225634 A1 9/2010 Levey
2010/0251295 A1 9/2010 Amento
2010/0269889 A1 10/2010 Reinhold
2010/0277400 A1 11/2010 Jeong
2010/0315319 A1 12/2010 Cok
2010/0315449 A1 12/2010 Chaji
2011/0050741 A1 3/2011 Jeong
2011/0063197 A1 3/2011 Chung
2011/0069089 A1 3/2011 Kopf
2011/0074762 A1 3/2011 Shirasaki
2011/0084993 A1 4/2011 Kawabe
2011/0109350 A1 5/2011 Chaji
2011/0169805 A1 7/2011 Yamazaki
2011/0191042 A1 8/2011 Chaji
2011/0205221 A1 8/2011 Lin
2012/0026146 A1 2/2012 Kim
2012/0169793 A1 7/2012 Nathan
2012/0299976 A1 11/2012 Chen
2012/0299978 A1 11/2012 Chaji
2014/0071189 A1 3/2014 Park
2014/0267215 A1 9/2014 Soni
2015/0356901 A1 12/2015 Chen
2016/0019851 A1 1/2016 Chen
2016/0365016 A1* 12/2016 Wu ..... G09G 5/02
2017/0039920 A1* 2/2017 Li ..... G09G 3/32

FOREIGN PATENT DOCUMENTS

CA 1 294 034 1/1992
CA 2 249 592 7/1998
CA 2 303 302 3/1999
CA 2 368 386 9/1999
CA 2 242 720 1/2000
CA 2 354 018 6/2000
CA 2 432 530 7/2002
CA 2 436 451 8/2002
CA 2 507 276 8/2002
CA 2 463 653 1/2004
CA 2 498 136 3/2004
CA 2 522 396 11/2004
CA 2 438 363 2/2005
CA 2 443 206 3/2005
CA 2 519 097 3/2005
CA 2 472 671 12/2005
CA 2 523 841 1/2006
CA 2 567 076 1/2006
CA 2 495 726 7/2006
CA 2 557 713 11/2006
CA 2 526 782 C 8/2007
CA 2 651 893 11/2007
CA 2 672 590 10/2009
CN 1588521 3/2005
CN 1601594 A 3/2005
CN 1886774 12/2006
CN 101395653 3/2009
CN 101908316 A 12/2010
CN 102656621 A 9/2012
CN 103562989 A 2/2014
DE 202006007613 9/2006
EP 0 478 186 4/1992
EP 1 028 471 A 8/2000

(56) References Cited

FOREIGN PATENT DOCUMENTS

| | | | |
|---|---|---|---|
| EP | 1 130 565 | A1 | 9/2001 |
| EP | 1 194 013 | | 4/2002 |
| EP | 1 321 922 | | 6/2003 |
| EP | 1 335 430 | A1 | 8/2003 |
| EP | 1 381 019 | | 1/2004 |
| EP | 1 429 312 | A | 6/2004 |
| EP | 1 439 520 | A2 | 7/2004 |
| EP | 1 465 143 | A | 10/2004 |
| EP | 1 473 689 | A | 11/2004 |
| EP | 1 517 290 | A2 | 3/2005 |
| EP | 1 521 203 | A2 | 4/2005 |
| GB | 2 399 935 | | 9/2004 |
| GB | 2 460 018 | | 11/2009 |
| JP | 09 090405 | | 4/1997 |
| JP | 10-254410 | | 9/1998 |
| JP | 11 231805 | | 8/1999 |
| JP | 2002-278513 | | 9/2002 |
| JP | 2003-076331 | | 3/2003 |
| JP | 2003-099000 | | 4/2003 |
| JP | 2003-173165 | | 6/2003 |
| JP | 2003-186439 | | 7/2003 |
| JP | 2003-195809 | | 7/2003 |
| JP | 2003-271095 | | 9/2003 |
| JP | 2003-308046 | | 10/2003 |
| JP | 2004-054188 | | 2/2004 |
| JP | 2004-226960 | | 8/2004 |
| JP | 2005-004147 | | 1/2005 |
| JP | 2005-099715 | | 4/2005 |
| JP | 2005-258326 | | 9/2005 |
| JP | 2005-338819 | | 12/2005 |
| TW | 569173 | | 1/2004 |
| TW | 200526065 | | 8/2005 |
| TW | 1239501 | | 9/2005 |
| WO | WO 98/11554 | | 3/1998 |
| WO | WO 99/48079 | | 9/1999 |
| WO | WO 01/27910 | A1 | 4/2001 |
| WO | WO 02/067327 | A | 8/2002 |
| WO | WO 03/034389 | | 4/2003 |
| WO | WO 03/063124 | | 7/2003 |
| WO | WO 03/075256 | | 9/2003 |
| WO | WO 2004/003877 | | 1/2004 |
| WO | WO 2004/015668 | A1 | 2/2004 |
| WO | WO 2004/034364 | | 4/2004 |
| WO | WO 2005/022498 | | 3/2005 |
| WO | WO 2005/055185 | | 6/2005 |
| WO | WO 2005/055186 | A1 | 6/2005 |
| WO | WO 2005/069267 | | 7/2005 |
| WO | WO 2005/122121 | | 12/2005 |
| WO | WO 2006/063448 | | 6/2006 |
| WO | WO 2006/128069 | | 11/2006 |
| WO | WO 2007/079572 | | 7/2007 |
| WO | WO 2008/057369 | | 5/2008 |
| WO | WO 2009/059028 | | 5/2009 |
| WO | WO 2009/127065 | | 10/2009 |
| WO | WO 2010/066030 | | 6/2010 |
| WO | WO 2010/120733 | | 10/2010 |

OTHER PUBLICATIONS

Alexander et al.: "Pixel circuits and drive schemes for glass and elastic AMOLED displays"; dated Jul. 2005 (9 pages).
Alexander et al.: "Unique Electrical Measurement Technology for Compensation Inspection and Process Diagnostics of AMOLED HDTV"; dated May 2010 (4 pages).
Ashtiani et al.: "AMOLED Pixel Circuit With Electronic Compensation of Luminance Degradation"; dated Mar. 2007 (4 pages).
Chaji et al.: "A Current-Mode Comparator for Digital Calibration of Amorphous Silicon AMOLED Displays"; dated Jul. 2008 (5 pages).
Chaji et al.: "A fast settling current driver based on the CCII for AMOLED displays"; dated Dec. 2009 (6 pages).
Chaji et al.: "A Low-Cost Stable Amorphous Silicon AMOLED Display with Full V~T- and V~O~L~E~D Shift Compensation"; dated May 2007 (4 pages).
Chaji et al.: "A low-power driving scheme for a-Si:H active-matrix organic light-emitting diode displays"; dated Jun. 2005 (4 pages).
Chaji et al.: "A low-power high-performance digital circuit for deep submicron technologies"; dated Jun. 2005 (4 pages).
Chaji et al.: "A novel a-Si:H AMOLED pixel circuit based on short-term stress stability of a-Si:H TFTs"; dated Oct. 2005 (3 pages).
Chaji et al.: "A Novel Driving Scheme and Pixel Circuit for AMOLED Displays"; dated Jun. 2006 (4 pages).
Chaji et al.: "A novel driving scheme for high-resolution large-area a-Si:H AMOLED displays"; dated Aug. 2005 (4 pages).
Chaji et al.: "A Stable Voltage-Programmed Pixel Circuit for a-Si:H AMOLED Displays"; dated Dec. 2006 (12 pages).
Chaji et al.: "A Sub-μA fast-settling current-programmed pixel circuit for AMOLED displays"; dated Sep. 2007.
Chaji et al.: "An Enhanced and Simplified Optical Feedback Pixel Circuit for AMOLED Displays"; dated Oct. 2006.
Chaji et al.: "Compensation technique for DC and transient instability of thin film transistor circuits for large-area devices"; dated Aug. 2008.
Chaji et al.: "Driving scheme for stable operation of 2-TFT a-Si AMOLED pixel"; dated Apr. 2005 (2 pages).
Chaji et al.: "Dynamic-effect compensating technique for stable a-Si:H AMOLED displays"; dated Aug. 2005 (4 pages).
Chaji et al.: "Electrical Compensation of OLED Luminance Degradation"; dated Dec. 2007 (3 pages).
Chaji et al.: "eUTDSP: a design study of a new VLIW-based DSP architecture"; dated May 2003 (4 pages).
Chaji et al.: "Fast and Offset-Leakage Insensitive Current-Mode Line Driver for Active Matrix Displays and Sensors"; dated Feb. 2009 (8 pages).
Chaji et al.: "High Speed Low Power Adder Design With A New Logic Style: Pseudo Dynamic Logic (SDL)" dated Oct. 2001 (4 pages).
Chaji et al.: "High-precision fast current source for large-area current-programmed a-Si flat panels"; dated Sep. 2006 (4 pages).
Chaji et al.: "Low-Cost AMOLED Television with IGNIS Compensating Technology"; dated May 2008 (4 pages).
Chaji et al.: "Low-Cost Stable a-Si:H AMOLED Display for Portable Applications"; dated Jun. 2006 (4 pages).
Chaji et al.: "Low-Power Low-Cost Voltage-Programmed a-Si:H AMOLED Display"; dated Jun. 2008 (5 pages).
Chaji et al.: "Merged phototransistor pixel with enhanced near infrared response and flicker noise reduction for biomolecular imaging"; dated Nov. 2008 (3 pages).
Chaji et al.: "Parallel Addressing Scheme for Voltage-Programmed Active-Matrix OLED Displays"; dated May 2007 (6 pages).
Chaji et al.: "Pseudo dynamic logic (SDL): a high-speed and low-power dynamic logic family"; dated 2002 (4 pages).
Chaji et al.: "Stable a-Si:H circuits based on short-term stress stability of amorphous silicon thin film transistors"; dated May 2006 (4 pages).
Chaji et al.: "Stable Pixel Circuit for Small-Area High-Resolution a-Si:H AMOLED Displays"; dated Oct. 2008 (6 pages).
Chaji et al.: "Stable RGBW AMOLED display with OLED degradation compensation using electrical feedback"; dated Feb. 2010 (2 pages).
Chaji et al.: "Thin-Film Transistor Integration for Biomedical Imaging and AMOLED Displays"; dated May 2008 (177 pages).
Chapter 3: Color Spaces "Keith Jack:" Video Demystified: "A Handbook for the Digital Engineer" 2001 Referex ORD-0000-00-00 USA EP040425529 ISBN: 1-878707-56-6 pp. 32-33.
Chapter 8: Alternative Flat Panel Display 1-25 Technologies ; Willem den Boer: "Active Matrix Liquid Crystal Display: Fundamentals and Applications" 2005 Referex ORD-0000-00-00 U.K.; XP040426102 ISBN: 0-7506-7813-5 pp. 206-209 p. 208.
European Partial Search Report Application No. 12 15 6251.6 European Patent Office dated May 30, 2012 (7 pages).
European Patent Office Communication Application No. 05 82 1114 dated Jan. 11, 2013 (9 pages).
European Patent Office Communication with Supplemental European Search Report for EP Application No. 07 70 1644.2 dated Aug. 18, 2009 (12 pages).

(56) References Cited

OTHER PUBLICATIONS

European Search Report Application No. 10 83 4294.0-1903 dated Apr. 8, 2013 (9 pages).
European Search Report Application No. EP 05 80 7905 dated Apr. 2, 2009 (5 pages).
European Search Report Application No. EP 05 82 1114 dated Mar. 27, 2009 (2 pages).
European Search Report Application No. EP 07 70 1644 dated Aug. 5, 2009.
European Search Report Application No. EP 10 17 5764 dated Oct. 18, 2010 (2 pages).
European Search Report Application No. EP 10 82 9593.2 European Patent Office dated May 17, 2013 (7 pages).
European Search Report Application No. EP 12 15 6251.6 European Patent Office dated Oct. 12, 2012 (18 pages).
European Search Report Application No. EP. 11 175 225.9 dated Nov. 4, 2011 (9 pages).
European Supplementary Search Report Application No. EP 09 80 2309 dated May 8, 2011 (14 pages).
European Supplementary Search Report Application No. EP 09 83 1339.8 dated Mar. 26, 2012 (11 pages).
Extended European Search Report Application No. EP 06 75 2777.0 dated Dec. 6, 2010 (21 pages).
Extended European Search Report Application No. EP 09 73 2338.0 dated May 24, 2011 (8 pages).
Extended European Search Report Application No. EP 11 17 5223, 4 dated Nov. 8, 2011 (8 pages).
Extended European Search Report Application No. EP 12 17 4465.0 European Patent Office dated Sep. 7, 2012 (9 pages).
Fan et al. "LTPS_TFT Pixel Circuit Compensation for TFT Threshold Voltage Shift and IR-Drop On the Power Line for Amolded Displays" 5 pages copyright 2012.
Goh et al. "A New a-Si:H Thin-Film Transistor Pixel Circuit for Active-Matrix Organic Light-Emitting Diodes" IEEE Electron Device Letters vol. 24 No. 9 Sep. 2003 pp. 583-585.
International Search Report Application No. PCT/CA2005/001844 dated Mar. 28, 2006 (2 pages).
International Search Report Application No. PCT/CA2006/000941 dated Oct. 3, 2006 (2 pages).
International Search Report Application No. PCT/CA2007/000013 dated May 7, 2007.
International Search Report Application No. PCT/CA2009/001049 dated Dec. 7, 2009 (4 pages).
International Search Report Application No. PCT/CA2009/001769 dated Apr. 8, 2010.
International Search Report Application No. PCT/IB2010/002898 Canadian Intellectual Property Office dated Jul. 28, 2009 (5 pages).
International Search Report Application No. PCT/IB2010/055481 dated Apr. 7, 2011 (3 pages).
International Search Report Application No. PCT/IB2011/051103 dated Jul. 8, 2011 3 pages.
International Search Report Application No. PCT/IB2012/052651 5 pages dated Sep. 11, 2012.
International Searching Authority Written Opinion Application No. PCT/IB2010/055481 dated Apr. 7, 2011 (6 pages).
International Searching Authority Written Opinion Application No. PCT/IB2012/052651 6 pages dated Sep. 11, 2012.
International Searching Authority Written Opinion Application No. PCT/IB2011/051103 dated Jul. 8, 2011 6 pages.
International Searching Authority Written Opinion Application No. PCT/IB2010/002898 Canadian Intellectual Property Office dated Mar. 30, 2011 (8 pages).
International Searching Authority Written Opinion Application No. PCT/CA2009/001769 dated Apr. 8, 2010 (8 pages).
Jafarabadiashtiani et al.: "A New Driving Method for a-Si AMOLED Displays Based on Voltage Feedback"; dated May 2005 (4 pages).
Lee et al.: "Ambipolar Thin-Film Transistors Fabricated by PECVD Nanocrystalline Silicon"; dated May 2006 (6 pages).
Ma e y et al: "Organic Light-Emitting Diode/Thin Film Transistor Integration for foldable Displays" Conference record of the 1997 International display research conference and international workshops on LCD technology and emissive technology. Toronto Sep. 15-19, 1997 (6 pages).
Matsueda y et al.: "35.1: 2.5-in. AMOLED with Integrated 6-bit Gamma Compensated Digital Data Driver"; dated May 2004 (4 pages).
Nathan et al. "Amorphous Silicon Thin Film Transistor Circuit Integration for Organic LED Displays on Glass and Plastic" IEEE Journal of Solid-State Circuits vol. 39 No. 9 Sep. 2004 pp. 1477-1486.
Nathan et al.: "Backplane Requirements for Active Matrix Organic Light Emitting Diode Displays"; dated Sep. 2006 (16 pages).
Nathan et al.: "Call for papers second international workshop on compact thin-film transistor (TFT) modeling for circuit simulation"; dated Sep. 2009 (1 page).
Nathan et al.: "Driving schemes for a-Si and LTPS AMOLED displays"; dated Dec. 2005 (11 pages).
Nathan et al.: "Invited Paper: a-Si for AMOLED—Meeting the Performance and Cost Demands of Display Applications (Cell Phone to HDTV)"; dated Jun. 2006 (4 pages).
Nathan et al.: "Thin film imaging technology on glass and plastic"; dated Oct. 31-Nov. 2, 2000 (4 pages).
Ono et al. "Shared Pixel Compensation Circuit for AM-OLED Displays" Proceedings of the 9th Asian Symposium on Information Display (ASID) pp. 462-465 New Delhi dated Oct. 8-12, 2006 (4 pages).
Philipp: "Charge transfer sensing" Sensor Review vol. 19 No. 2 Dec. 31, 1999 (Dec. 31, 1999) 10 pages.
Rafati et al.: "Comparison of a 17 b multiplier in Dual-rail domino and in Dual-rail D L (D L) logic styles"; dated 2002 (4 pages).
Safavaian et al.: "Three-TFT image sensor for real-time digital X-ray imaging"; dated Feb. 2, 2006 (2 pages).
Safavian et al.: "3-TFT active pixel sensor with correlated double sampling readout circuit for real-time medical x-ray imaging"; dated Jun. 2006 (4 pages).
Safavian et al.: "A novel current scaling active pixel sensor with correlated double sampling readout circuit for real time medical x-ray imaging"; dated May 2007 (7 pages).
Safavian et al.: "A novel hybrid active-passive pixel with correlated double sampling CMOS readout circuit for medical x-ray imaging"; dated May 2008 (4 pages).
Safavian et al.: "Self-compensated a-Si:H detector with current-mode readout circuit for digital X-ray fluoroscopy"; dated Aug. 2005 (4 pages).
Safavian et al.: "TFT active image sensor with current-mode readout circuit for digital x-ray fluoroscopy [5969D-82]"; dated Sep. 2005 (9 pages).
Smith, Lindsay I., "A tutorial on Principal Components Analysis," dated Feb. 26, 2001 (27 pages).
Stewart M. et al. "Polysilicon TFT technology for active matrix OLED displays" IEEE transactions on electron devices vol. 48 No. 5 May 2001 (7 pages).
Vygranenko et al.: "Stability of indium-oxide thin-film transistors by reactive ion beam assisted deposition"; dated Feb. 2009.
Wang et al.: "Indium oxides by reactive ion beam assisted evaporation: From material study to device application," dated Mar. 2009 (6 pages).
Yi He et al. "Current-Source a-Si:H Thin Film Transistor Circuit for Active-Matrix Organic Light-Emitting Displays" IEEE Electron Device Letters vol. 21 No. 12 Dec. 2000 pp. 590-592.
International Search Report Application No. PCT/IB2013/059074, dated Dec. 18, 2013 (5 pages).
International Searching Authority Written Opinion Application No. PCT/IB2013/059074, dated Dec. 18, 2013 (8 pages).
Extended European Search Report Application No. EP 15173106.4 dated Oct. 15, 2013 (8 pages).
International Search Report and Written Opinion in International Application No. PCT/IB2013/060755, dated Apr. 15, 2014 (8 pages).
International Search Report Application No. PCT/IB2017/050170, dated May 5, 2017 (3 pages).
International Searching Authority Written Opinion Application No. PCT/IB2017/050170, dated May 5, 2017 (4 pages).

(56) References Cited

OTHER PUBLICATIONS

Extended European Search Report for Application No. EP 18181961.6 dated Oct. 9, 2018 (9 pages).

* cited by examiner

SYSTEMS AND METHODS OF MULTIPLE COLOR DRIVING

PRIORITY CLAIM CROSS-REFERENCE TO RELATED APPLICATIONS

This application is a continuation of U.S. patent application Ser. No. 15/293,526, filed Oct. 14, 2016, now allowed, which claims priority to Canadian Application No. 2,908,285, filed Oct. 14, 2015, each of which is hereby incorporated by reference herein in its entirety.

FIELD OF THE INVENTION

The present disclosure relates to color data driving for light emissive visual display technology, and particularly to systems and methods for driving pixels with more than three primary color subpixels in an active matrix light emitting diode device (AMOLED) and other emissive displays.

BRIEF SUMMARY

According to one aspect, there is provided a color data driver for an emissive display system having pixels, each pixel having a number of primary color subpixels, each primary color subpixel having a light emitting device, the color data driver comprising: data storage for receiving color data for a number of active primary color subpixels of a pixel, the number of active primary color subpixels less than a number of primary color subpixels of the pixel; decoders for performing digital to analog conversion of the color data to generate analog color data, the number of decoders corresponding to a preset maximum number of active primary color subpixels of a pixel which is less than the number of primary color subpixels of the pixel; and a color decoder for receiving the analog color data for the number of active primary color subpixels and for providing the color data for the active primary color subpixels to the pixel, the color decoder comprising: a switch fabric controllable to select a switching state being a combination of switching from color data inputs of the color decoder to color data outputs of the color decoder with use of color bits provided to the color decoder, the switch fabric for, according to the switching state, switching to each color data output one of at least one color data input, and for switching to at least one color data output, one of at least two color data inputs.

In some embodiments, the switch fabric comprises a set of switches for connecting to at least one bias voltage, color data outputs which are not being used for providing to the pixel the color data for the active primary color subpixels. In some embodiments, the at least one bias voltage comprises a different bias voltage for each color data output.

In some embodiments, the color bits uniquely identifies the switching state from a number of preset possible states, the bit length of the color bits corresponding to a shortest bit length required to select any of the switching states from the number of preset possible states. In some embodiments, the number of present possible states is two and the bit length of the color bits is one.

In some embodiments, the number of active primary color subpixels is three, the preset maximum number of active primary color subpixels of a pixel is three, and the number of primary color subpixels of the pixel is four. In some embodiments, the primary color subpixels of the pixel consist of a red subpixel, a green subpixel, a blue subpixel, and a white subpixel. In some embodiments, the color bits uniquely identifies the switching state from four preset possible states and the bit length of the color bits is two, and wherein the switch fabric comprises a set of switches for connecting to at least one bias voltage, color data outputs which are not being used for providing to the pixel the color data for the active primary color subpixels.

In some embodiments, the color decoder receives the analog color data from the decoders via buffers, the number of buffers corresponding to the number of decoders.

In some embodiments, wherein the data storage comprises a switch register for storing the color data and the color bits, and for providing the color bits to the color decoder.

According to another aspect there is provided, a method of data driving for an emissive display system having pixels, each pixel having a number of primary color subpixels, each primary color subpixel having a light emitting device, the method comprising: receiving color data for a number of active primary color subpixels of a pixel, the number of active primary color subpixels less than a number of primary color subpixels of the pixel; performing digital to analog conversion of the color data to generate analog color data using decoders, the number of decoders corresponding to a preset maximum number of active primary color subpixels of a pixel which is less than the number of primary color subpixels of the pixel; receiving by a color decoder the analog color data for the number of active primary color subpixels; and providing by the color decoder the color data for the active primary color subpixels to the pixel with use of a switch fabric, the providing comprising: selecting a switching state being a combination of switching from color data inputs of the color decoder to color data outputs of the color decoder with use of color bits provided to the color decoder; according to the switching state, switching to each color data output one of at least one color data input; and according to the switching state, switching to at least one color data output, one of at least two color data inputs.

In some embodiments, the step of providing further comprises: according to the switching state, connecting to at least one bias voltage, color data outputs which are not being used for providing to the pixel the color data for the active primary color subpixels. In some embodiments, the at least one bias voltage comprises a different bias voltage for each color data output.

In some embodiments, the color bits uniquely identifies the switching state from four preset possible states and the bit length of the color bits is two, and wherein the step of providing further comprises: connecting to at least one bias voltage, color data outputs which are not being used for providing to the pixel the color data for the active primary color subpixels.

In some embodiments, the receiving by the color decoder of the analog color data from the decoders is via buffers, the method further comprising: receiving by buffers the analog color data from the decoders, the number of buffers corresponding to the number of decoders.

Some embodiments further provide for: storing the color data and the color bits in a switch register; and providing the color bits from the switch register to the color decoder.

The foregoing and additional aspects and embodiments of the present disclosure will be apparent to those of ordinary skill in the art in view of the detailed description of various embodiments and/or aspects, which is made with reference to the drawings, a brief description of which is provided next.

BRIEF DESCRIPTION OF THE DRAWINGS

The foregoing and other advantages of the disclosure will become apparent upon reading the following detailed description and upon reference to the drawings.

Figure 1A:
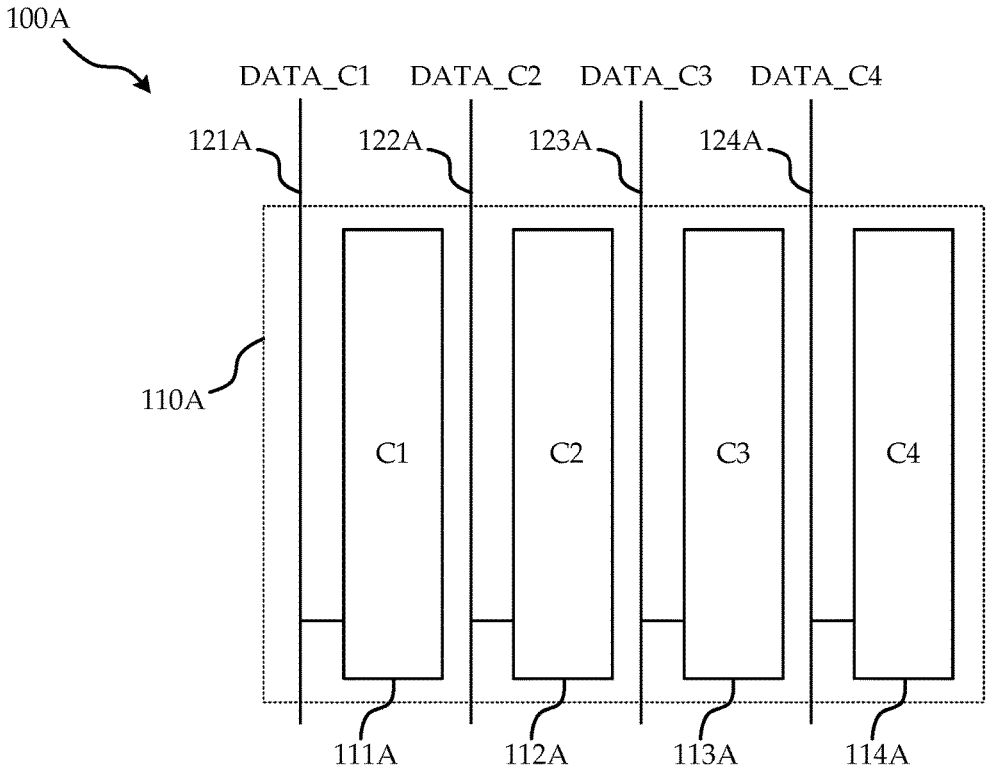
FIG. 1A (PRIOR ART)
FIG. 1A illustrates a known pixel with more than three primary color subpixels.

While the present disclosure is susceptible to various modifications and alternative forms, specific embodiments or implementations have been shown by way of example in the drawings and will be described in detail herein. It should be understood, however, that the disclosure is not intended to be limited to the particular forms disclosed. Rather, the disclosure is to cover all modifications, equivalents, and alternatives falling within the spirit and scope of an invention as defined by the appended claims.

DETAILED DESCRIPTION

For several reasons such as ease of manufacturing, wider color gamut, lower power consumption, among others, it is often preferred to use more than three primary color subpixels. In one example, each pixel consists of red, green, blue and white subpixels. FIG. 1A depicts a known pixel 100A with four primary color subpixels, 111A (C1), 112A (C2), 113A (C3), and 114A (C4), where primary colors C1, C2, C3, and C4, correspond, for example, to red, green, blue and white respectively. In such a case, the data is converted from RGB to RGBW at the image processors or at the controller or timing controller (TCON) and then passed to the data driver. As a result, each driver channel for a pixel requires at least four outputs to the pixel (in other cases it may require more outputs depending upon the number of primary color subpixels). For example, in FIG. 1A, red data is output over data line DATA_C1 121A, green data is output over data line DATA_C2 122A, blue data is output over data line DATA_C3 123A, and white data is output over data line DATA_C4 124A.

Figure 1B:
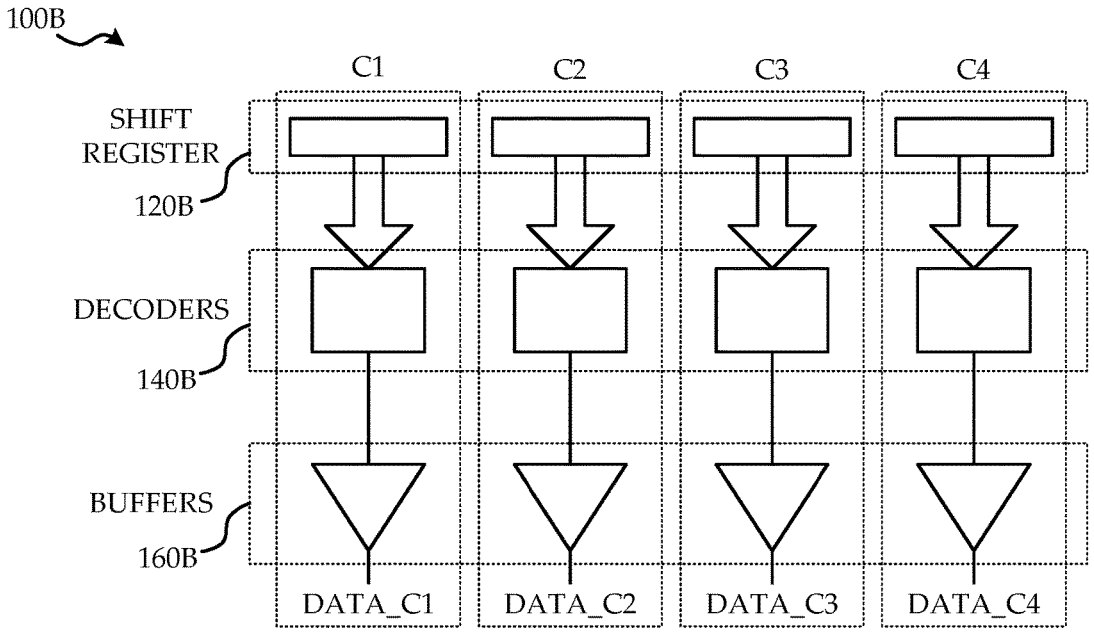
FIG. 1B (PRIOR ART)
FIG. 1B illustrates known multiple color driving of a pixel with more than three primary color subpixels.

FIG. 1B shows an example of a known driver channel 100B for a 4-subpixel pixel structure such as that illustrated in FIG. 1. The driver channel 100B consists of four parallel channels, one for each primary color C1, C2, C3, and C4, each utilizing a portion of shift registers 120B, decoders 140B, and buffers 160B. The digital data is passed to the data driver through shift registers 120B or through a combination of shift registers and latches. The digital data is converted into the analog domain through DACs (digital to analog converters) of which the decoders 140B comprise. The converted analog voltage is used to drive the panel through buffers 160B. The output of the buffers DATA_C1, DATA_C2, DATA_C3, and DATA_C4, constitute the primary color data which is input to a pixel such as that depicted in FIG. 1A.

The main issue with this structure and method of driving is that the data transfer rate to the data driver is increased by an amount corresponding to the number of extra primary colors. In the case of using an RGBW structure, the data rate is 25% more than the typical RGB data driver. This is more of a challenge in the case of higher resolution displays and higher frame rates. For a 4K display running at 120 Hz, the data rate is 3.7 GB/s using an RGB structure, while the date rate for the same display is 4.9 GB/s using RGBW. Another challenge of known systems using RGBW versus RGB is that the size of the driver increases by 25% causing more cost and power consumption.

Providing in accordance with known driving techniques, a parallel and additional channel for every primary color beyond three leads to a proportional increase in data rate, driver size, increasing costs and power consumption.

While the embodiments described herein below are in the context of AMOLED displays it should be understood that the systems and methods described herein are applicable to any other display comprising pixels having more than three primary color subpixels, including but not limited to light emitting diode displays (LED), electroluminescent displays (ELD), organic light emitting diode displays (OLED), plasma display panels (PSP), among other displays.

It should be understood that the embodiments described herein pertain to systems and methods of driving are not limited to any particular display technology underlying their operation and the operation of the displays in which they are implemented. The systems and methods described herein are applicable to any number of various types and implementations of various visual display technologies.

Figure 2:
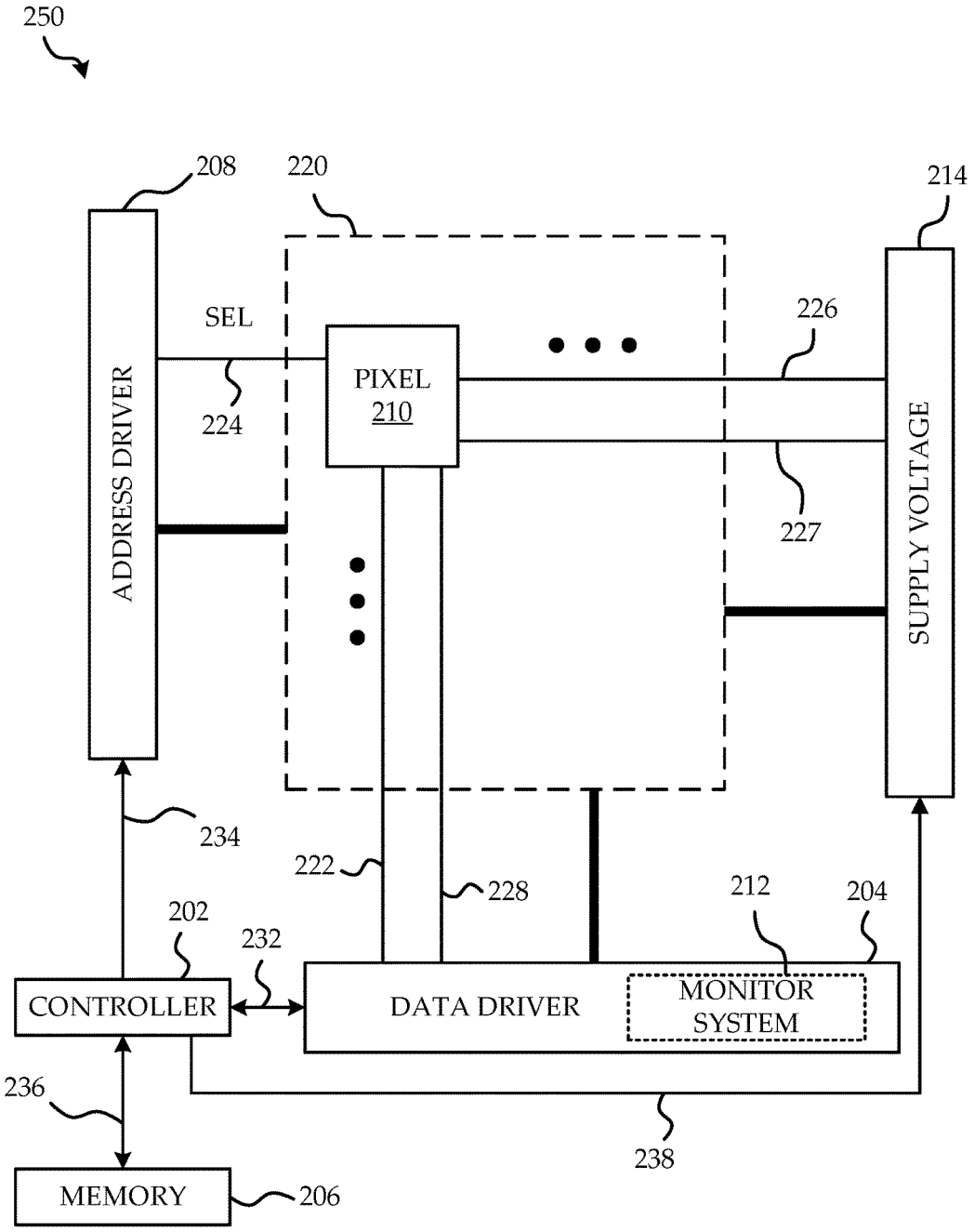
FIG. 2 illustrates an example display system which participates in and whose pixels are to be driven with use of the color driving systems and methods disclosed.

FIG. 2 is a diagram of an example display system 250 implementing systems and methods described further below. The display system 250 includes a display panel 220, an address driver 208, a data driver 204, a controller 202, and a memory storage 206.

The display panel 220 includes an array of pixels 210 (only one explicitly shown) arranged in rows and columns. Each of the pixels 210 is individually programmable to emit light with individually programmable luminance values. The controller 202 receives digital data indicative of information to be displayed on the display panel 220. The controller 202 sends signals 232 to the data driver 204 and scheduling signals 234 to the address driver 208 to drive the pixels 210 in the display panel 220 to display the information indicated. The plurality of pixels 210 of the display panel 220 thus comprise a display array or display screen adapted to dynamically display information according to the input digital data received by the controller 202. The display screen can display images and streams of video information from data received by the controller 202. The supply voltage 214 provides a constant power voltage or can serve as an adjustable voltage supply that is controlled by signals from the controller 202. The display system 250 can also incorporate features from a current source or sink (not shown) to provide biasing currents to the pixels 210 in the display panel 220 to thereby decrease programming time for the pixels 210.

For illustrative purposes, only one pixel 210 is explicitly shown in the display system 250 in FIG. 2. It is understood that the display system 250 is implemented with a display screen that includes an array of a plurality of pixels, such as the pixel 210, and that the display screen is not limited to a particular number of rows and columns of pixels. For example, the display system 250 can be implemented with a display screen with a number of rows and columns of pixels commonly available in displays for mobile devices, monitor-based devices, and/or projection-devices. In a multichannel or color display, a number of different types of pixels, each responsible for reproducing color of a particular channel or color such as red, green, blue, or white will be present in the display. Pixels of this kind may also be referred to as "subpixels" as a group of them collectively provide a desired color at a particular row and column of the display, which group of subpixels may collectively also be referred to as a "pixel".

The subpixels of the pixel 210 are operated by a driving circuit or pixel circuit that generally includes a driving transistor and a light emitting device. The light emitting device can optionally be an organic light emitting diode, but implementations of the present disclosure apply to pixel circuits having other electroluminescence devices, including current-driven light emitting devices and those listed above. The driving transistor in the pixel 210 can optionally be an n-type or p-type amorphous silicon thin-film transistor, but implementations of the present disclosure are not limited to pixel circuits having a particular polarity of transistor or only to pixel circuits having thin-film transistors. The pixel circuit 210 can also include a storage capacitor for storing programming information and allowing the pixel circuit 210 to drive the light emitting device after being addressed. Thus, the display panel 220 can be an active matrix di splay array.

As illustrated in FIG. 2, the pixel 210 illustrated as the top-left pixel in the display panel 220 is coupled to a select lines 224, a supply line 226, a data lines 222, and a monitor line 228. A read line may also be included for controlling connections to the monitor line. In one implementation, the supply voltage 214 can also provide a second supply line to the pixel 210. For example, each pixel can be coupled to a first supply line 226 charged with Vdd and a second supply line 227 coupled with Vss, and the pixel circuits 210 can be situated between the first and second supply lines to facilitate driving current between the two supply lines during an emission phase of the pixel circuit. It is to be understood that each of the pixels 210 in the pixel array of the display 220 is coupled to appropriate select lines, supply lines, data lines, and monitor lines. It is noted that aspects of the present disclosure apply to pixels having additional connections, such as connections to additional select lines, and to pixels having fewer connections.

With reference to the pixel 210 of the display panel 220, the select lines 224 is provided by the address driver 208, and can be utilized to enable, for example, a programming operation of the pixel 210 by activating a switch or transistor to allow the data lines 222 to program the various subpixels of the pixel 210. The data lines 222 convey programming information from the data driver 204 to the pixel 210. For example, the data lines 222 can be utilized to apply programming voltages or programming current to the subpixels of the pixel 210 in order to program the subpixels of the pixel 210 to emit a desired amount of luminance. The programming voltages (or programming current) supplied by the data driver 204 via the data lines 222 are voltages (or currents) appropriate to cause the subpixels of the pixel 210 to emit light with a desired amount of luminance according to the digital data received by the controller 202. The programming voltages (or programming currents) can be applied to the subpixels of the pixel 210 during a programming operation of the pixel 210 so as to charge storage devices within the subpixels of the pixel 210, such as a storage capacitor, thereby enabling the subpixels of the pixel 210 to emit light with the desired amount of luminance during an emission operation following the programming operation. For example, the storage device in a subpixel of the pixel 210 can be charged during a programming operation to apply a voltage to one or more of a gate or a source terminal of the driving transistor during the emission operation, thereby causing the driving transistor to convey the driving current through the light emitting device according to the voltage stored on the storage device.

Generally, in each subpixel of the pixel 210, the driving current that is conveyed through the light emitting device by the driving transistor during the emission operation of the pixel 210 is a current that is supplied by the first supply line 226 and is drained to a second supply line 227. The first supply line 226 and the second supply line 227 are coupled to the voltage supply 214. The first supply line 226 can provide a positive supply voltage (e.g., the voltage commonly referred to in circuit design as "Vdd") and the second supply line 227 can provide a negative supply voltage (e.g., the voltage commonly referred to in circuit design as "Vss"). Implementations of the present disclosure can be realized where one or the other of the supply lines (e.g., the supply line 227) is fixed at a ground voltage or at another reference voltage.

The display system 250 also includes a monitoring system 212. With reference again to the pixel 210 of the display panel 220, the monitor line 228 connects the pixel 210 to the monitoring system 212. The monitoring system 212 can be integrated with the data driver 204, or can be a separate stand-alone system. In particular, the monitoring system 212 can optionally be implemented by monitoring the current and/or voltage of the data line 222 during a monitoring operation of the pixel 210, and the separate monitor line 228 can be entirely omitted.

Figure 3:
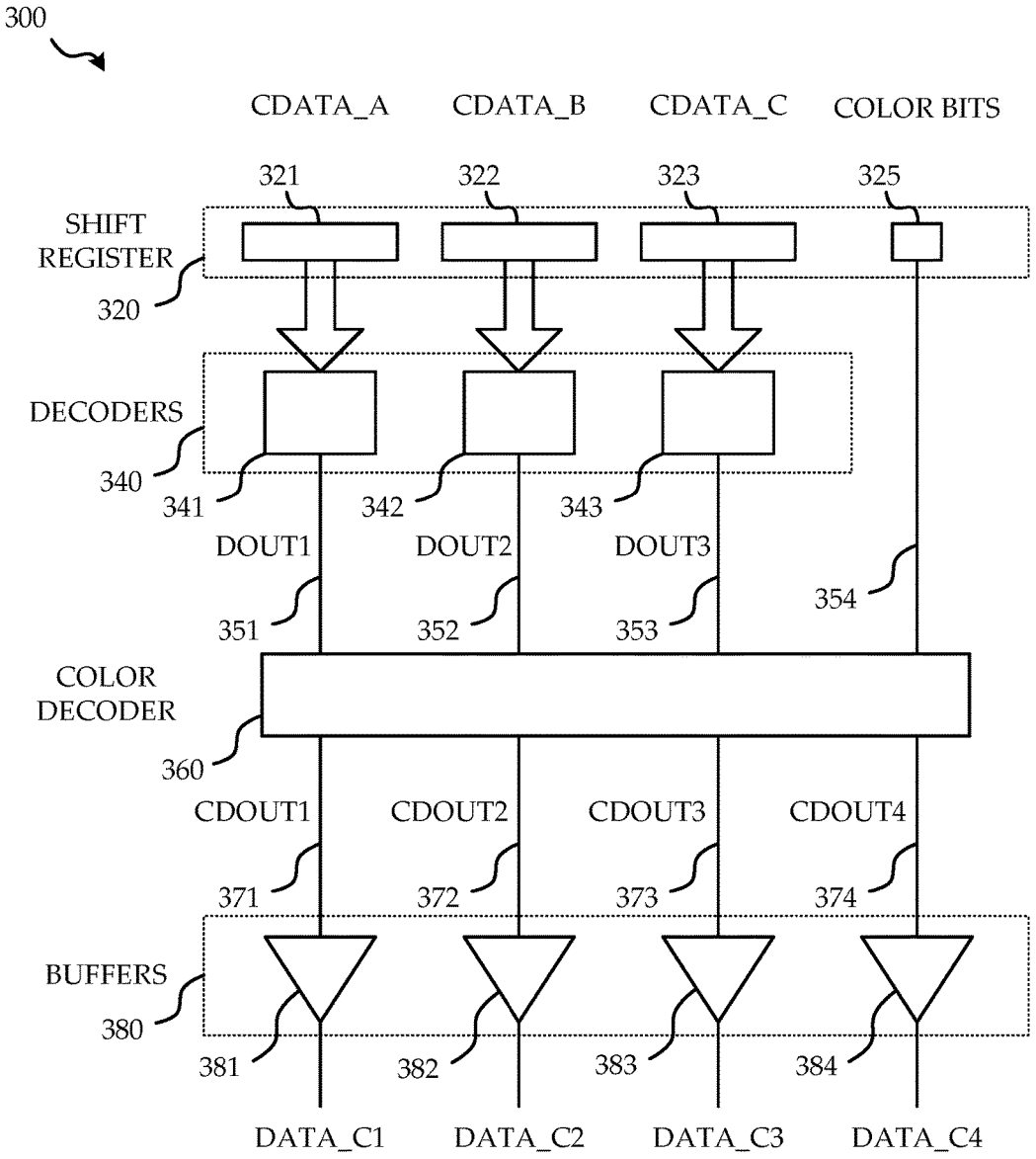
FIG. 3 illustrates a multiple color data driver according to an embodiment.

Referring to FIG. 3, a multiple color data driver 300 according to an embodiment will now be described. The data driver 300 and associated methods address the challenges associated with the use of extra color output for a pixel i.e. for dealing with pixels having more than four primary color subpixels. In most of cases, only a subset of the primary color subpixels are active for each color mapping. For example, a color mapping from RGB to RGBW by the image processors or the controller for any particular color might only use three (or possibly fewer) of the primary color subpixels R, G, B, and W. In such a case, the number of outputs of the data driver 300 for a channel, corresponding to the number of primary color subpixels of a pixel in a column, is more than the total number of active primary color subpixels emitting light, at any one time, which in the case illustrated is three (or less). The data driver 300 therefore, uses fewer decoders 341, 342, 343, and hence fewer DACs along with a color decoder 360, described below, in order to provide color data signals to all the primary color subpixels of a pixel only as required. Once a maximum number S of simultaneously active primary color subpixels per pixel is determined, for example as illustrated S=3, this number is used to define the number of decoders and hence DACs for each pixel. The color decoder 360 is used to align each of the DACs outputs to different outputs depending on the color value. The color decoder 360 can use the data passed to the source driver by the TCON or the image processor to align the DACs or it can calculate the DACs' status by itself based on color values.

FIG. 3 shows an example of data driver 300 structure using a color decoder 360. In accordance with a particular color mapping from RGB to RGBW, color data is provided to the shift register 320. Thus the color data includes values only for those primary color subpixels that are active for the mapping. Since the portions of the shift register 320 do not correspond to a unique particular primary color in a static manner, color data to be stored in the shift register are designated in FIG. 3 as CDATA_A, CDATA_B, and CDATA_C each stored respectively in first second and third shift register portions 321, 322, 323 of the shift register 320. Color data CDATA_A, CDATA_B, and CDATA_C are output from the shift registers 321, 322, 323, to respective decoders 341, 342, 343, each including a DAC for converting the digital color data CDATA_A, CDATA_B, and CDATA_C into respective analog decoder outputs, DOUT1 351, DOUT2 352, DOUT3 353.

In addition to color data for the three active primary colors, color bits are provided to the shift register 320 which determines which of the primary color subpixels each of the color data values, CDATA_A, CDATA_B, CDATA_C corresponds to. For example, for a particular color mapping, color bits would designate CDATA_A as data for the red subpixel, CDATA_B as data for the blue subpixel, and CDATA_C as data for the white subpixel. In FIG. 3 the color bits are illustrated as being provided to the driver 300 in a color bits portion 325 of the shift register 320. Alternatively the color bits can be provided with a separate shift register (not shown). In the case color bits is part of the main shift register 320, the bit mapping can be any combination as is apparent to persons of skill in the art. For example, in some cases, the color bits are assigned at the end (or beginning) of the shift register data for a pixel.

The color bits contain enough information for the color decoder 360 to determine how to switch the analog color data DOUT1, DOUT2, DOUT3, input to the color decoder 360, as outputs of the color decoder CDOUT1 371, CDOUT2 372, CDOUT3 373, CDOUT4 374, where each output of the color decoder CDOUT1, CDOUT2, CDOUT3, CDOUT4, corresponds to a respective primary color subpixel. These analog voltages output from the color decoder 360 are used to drive buffers 380 which include a respective buffer 381, 382, 383, 384 for each output of the color decoder 360. The drive buffers 381, 382, 383, 384 output drive signals DATA_C1, DATA_C2, DATA_C3, DATA_C4 which constitutes the primary color data which is provided to the pixel.

In some embodiments, rather than located after the color decoder 360, the buffers 380 can be located between the decoders 340 and the color decoder 360 to share the buffers between active outputs. In such a case the number of buffers is reduced to equal the number of decoders, which in this case is three.

In the example embodiment depicted in FIG. 3 a four-color sub-pixel pixel structure is contemplated. In this case, only three primary color subpixels are active at any one time for color point. Table 1 shows an example of the possible combinations of active primary color sub-pixels for a four-color sub-pixel structure, where colors A, B, and C are the three active subpixels and C1, C2, C3, and C4, are for example, R,G,B,W. It is obvious to an expert in the art that the combination of active colors can be different and can be in different coordination and correspond to different primary colors such as yellow, magenta, etc.

TABLE 1

An example of active color for a four-color sub-pixel

| Color A | Color B | Color C |
|---|---|---|
| C1 | C2 | C3 |
| C1 | C2 | C4 |
| C1 | C3 | C4 |
| C2 | C3 | C4 |

As can be seen in table 1, there are four possible modes or combinations of three active primary color subpixels out of four primary subpixels per pixel. If every combination consists of S active subpixels from a total number of N primary color subpixels per pixel, the number of combinations is S-choose-N or S!/N!*(S—N)!, S≤N. In the case illustrated, since there are four possible modes or combinations, a 2-bit "color bits" would be sufficient to designate which of the four modes or combinations is applicable. In some cases, not every color mapping will require the same number of active primary color subpixels. For example it may be desired that for some colors only a mapping to two or even one primary color subpixel be applied. In such a case the number of possibilities may increase. For example, (R,G,W), (R,B,W), (G,B,W), (R,G,B), and (W) may be desired and as such they may form the preset states the color decoder will operate in. In other embodiments there may be a limited set of combinations such as (C1, C2, C3) and (C2, C3, C4) in which case the number of preset modes decreases. In this particular case with only two modes, a single bit "color bits" would suffice to convey to the color decoder 360 which combination is applicable. Generally speaking, the data driver and associated driving method contemplates any number of possible combinations for which only a subset of primary color subpixels of a pixel are used at any one time.

Figure 4:
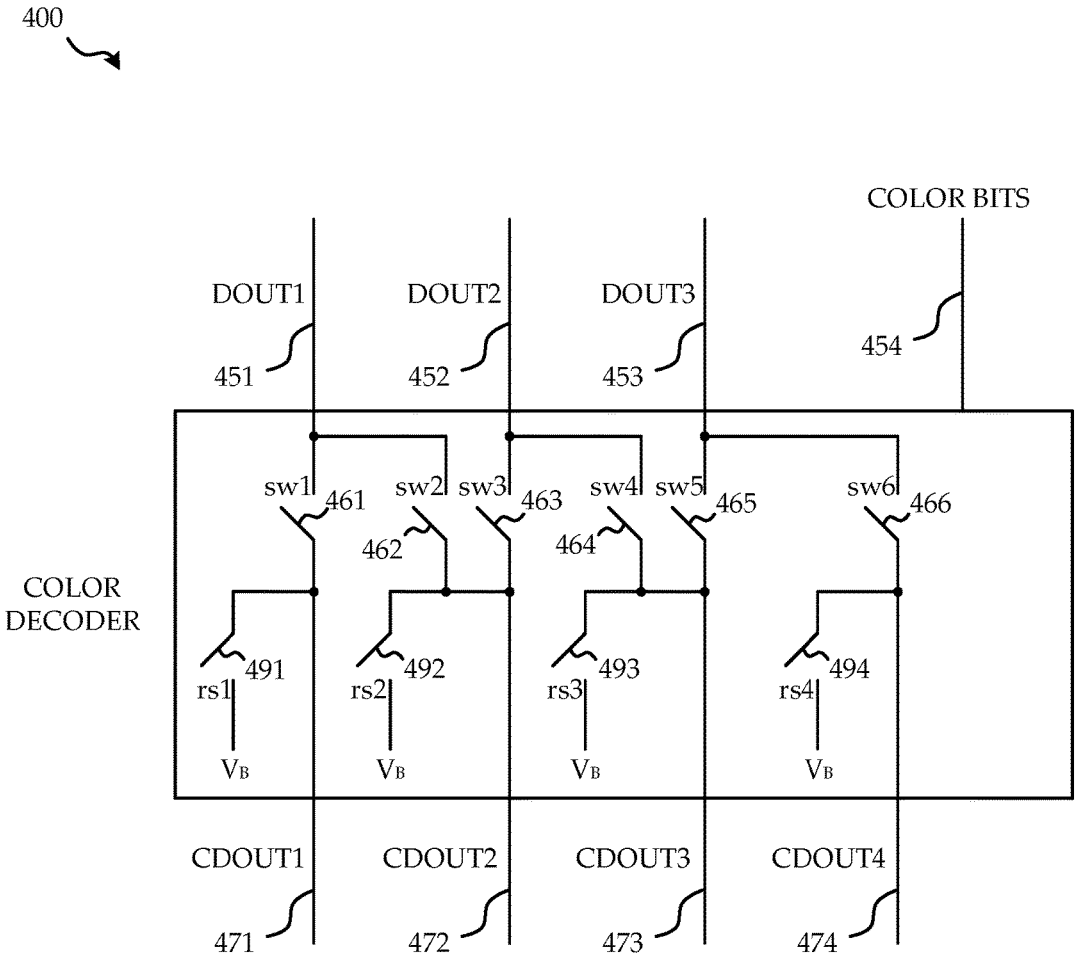
FIG. 4 illustrates a color decoder of a multiple color data driver according to an embodiment.

With reference also to FIG. 4, a color decoder 400 according to an embodiment will now be described.

The color decoder 400 takes as inputs 451, 452, 453, the analog color data DOUT1, DOUT2, DOUT3 output from the decoders, as well as color bits 454 input directly from the shift register.

The color decoder 400 includes a switch fabric having a number of switches for connecting particular inputs 451, 452, 453 of the color decoder 400 to particular color data outputs 471, 472, 473, 474 in accordance with the particular mode or combination as determined by the color bits 454, which is also referred to as a switch state. The switches of the switch fabric are used to enable different active outputs 471, 472, 473, 474 to be connected to particular inputs 451, 452, 453 from the decoders (hence the DACs). For example, in one case of "C1, C2, C3", the ON switches are sw1 461, sw3 463, and sw5 465 as well as reset switch rs4 494 to connect the output for C4 to a bias voltage. The inactive outputs are connected to a bias voltage "$V_B$". The bias voltage can be different for each output or it can be the same for all outputs. The result is that the active output color data CDOUT1 471, CDOUT2 472, CDOUT3 473, CDOUT4 474, if corresponding to an active primary color subpixel, includes the corresponding color data input to the color decoder 400 DOUT1, DOUT2, DOUT3, and if corresponding to a non-active subpixel, includes only a bias voltage "$V_B$".

Table 2 summarizes the states of the switches of the color decoder 400 depicted in FIG. 4 for driving the particular pixel combinations as summarized in Table 1.

TABLE 2

An example of color decoder functions.

| | sw1 | sw2 | sw3 | sw4 | sw5 | sw6 | rs1 | rs2 | rs3 | rs4 |
|---|---|---|---|---|---|---|---|---|---|---|
| C1, C2, C3 | ON | OFF | ON | OFF | ON | OFF | OFF | OFF | OFF | ON |
| C1, C2, C4 | ON | OFF | ON | OFF | OFF | ON | OFF | OFF | ON | OFF |
| C1, C3, C4 | ON | OFF | OFF | ON | OFF | ON | OFF | ON | OFF | OFF |
| C2, C3, C4 | OFF | ON | OFF | ON | OFF | ON | ON | OFF | OFF | OFF |

Each output of the color decoder 400 is coupled via a reset switch 491, 492, 493, 494, to a bias voltage or voltages, and two outputs of the color decoder are each couplable via the switches 462, 463, 464, 465 to more than one input of the color decoder. All the switches of the switching fabric 491, 492, 493, 494, 462, 463, 464, 465 are operated so that each output is coupled to only one of a voltage bias or one particular input at any one time.

It should be understood that there are a number of various possible configurations of switches in switch fabrics for switching the inputs of the color decoder 400 to the active outputs in accordance with the teachings above.

Referring once again to FIG. 3, generally each output of the color decoder 360 corresponding to a primary color subpixel which can be inactive is connected in the color decoder 360 via switch fabric to a bias voltage, and each output of the color decoder 360 corresponding to a primary color which can be active is couplable in the color decoder via switch fabric to one or more inputs of the color decoder 360. According to the switch state, each color output is coupled to only to a voltage bias or only to one input of the one or more inputs at any one time.

While particular implementations and applications of the present disclosure have been illustrated and described, it is to be understood that the present disclosure is not limited to the precise construction and compositions disclosed herein and that various modifications, changes, and variations can be apparent from the foregoing descriptions without departing from the spirit and scope of an invention as defined in the appended claims.

What is claimed is:

1. A color data driver for an emissive display system having pixels, each pixel having a number of primary color subpixels, each primary color subpixel having a light emitting device, the color data driver comprising:

data storage for storing color data for a number of active primary color subpixels of a pixel, the number of active primary color subpixels less than a number of primary color subpixels of the pixel; and a color decoder for receiving the color data for the number of active primary color subpixels and for providing the color data for the active primary color subpixels to the pixel, the color decoder comprising:

a switch fabric controllable to select a switching state being a combination of switching from color data inputs of the color decoder to color data outputs of the color decoder.

2. The color data driver of claim 1, wherein the switch fabric comprises a set of switches controllable for, according to the switching state, switching to each color data output one of at least one color data input, and switching each color data input to one of at least two color data outputs.

3. The color data driver of claim 2, wherein the switch fabric comprises a set of switches controllable for connecting to at least one bias voltage, color data outputs which are not being used for providing to the pixel the color data for the active primary color subpixels.

4. The color data driver of claim 3 wherein the at least one bias voltage comprises a different bias voltage for each color data output.

5. The color data driver of claim 1, wherein the switch fabric is controllable to select the switching state with use of color bits provided to the color decoder and wherein the color bits uniquely identifies the switching state from a number of preset possible states, the bit length of the color bits corresponding to a shortest bit length required to select any of the switching states from the number of preset possible states.

6. The color data driver of claim 5, wherein the number of present possible states is two and the bit length of the color bits is one.

7. The color data driver of claim 1, wherein the number of active primary color subpixels is three and the number of primary color subpixels of the pixel is four.

8. The color data driver of claim 7, wherein the primary color subpixels of the pixel consist of a red subpixel, a green subpixel, a blue subpixel, and a white subpixel.

9. The color data driver of claim 8, wherein the switch fabric is controllable to select the switching state with use of color bits provided to the color decoder and wherein the color bits uniquely identifies the switching state from four preset possible states and the bit length of the color bits is two, and wherein the switch fabric comprises a set of switches for connecting to at least one bias voltage, color data outputs which are not being used for providing to the pixel the color data for the active primary color subpixels.

10. The color data driver of claim 1, further comprising decoders for receiving the color data from the data storage and for performing digital to analog conversion of the color data to generate analog color data, the number of decoders corresponding to a preset maximum number of active primary color subpixels of a pixel which is less than the number of primary color subpixels of the pixel, and wherein the color data received by the color decoder comprises the analog color data.

11. The color data driver of claim 10, wherein the color decoder receives the analog color data from the decoders via buffers, the number of buffers corresponding to the number of decoders.

12. The color data driver of claim 1, wherein the data storage comprises a switch register for storing the color data.

13. A method of data driving for an emissive display system having pixels, each pixel having a number of primary color subpixels, each primary color subpixel having a light emitting device, the method comprising:

storing color data for a number of active primary color subpixels of a pixel, the number of active primary color subpixels less than a number of primary color subpixels of the pixel;

receiving by a color decoder the color data for the number of active primary color subpixels; and providing by the color decoder the color data for the active primary color subpixels to the pixel with use of a switch fabric, the providing comprising:

selecting a switching state being a combination of switching from color data inputs of the color decoder to color data outputs of the color decoder.

14. The method of claim 13, wherein the step of providing further comprises:

according to the switching state, switching to each color data output one of at least one color data input; and according to the switching state, switching each color data input to one of at least two color data outputs.

15. The method of claim 14, wherein the step of providing further comprises: according to the switching state, connecting to at least one bias voltage, color data outputs which are not being used for providing to the pixel the color data for the active primary color subpixels.

16. The method of claim 15, wherein the at least one bias voltage comprises a different bias voltage for each color data output.

17. The method of claim 13, wherein said selecting the switching state is performed with use of color bits provided to the color decoder, and wherein the color bits uniquely identifies the switching state from a number of preset possible states, the bit length of the color bits corresponding to a shortest bit length required to select any of the switching states from the number of preset possible states.

18. The method of claim 17, wherein the number of present possible states is two and the bit length of the color bits is one.

19. The method of claim 13, wherein the number of active primary color subpixels is three and the number of primary color subpixels of the pixel is four.

20. The method of claim 19, wherein the primary color subpixels of the pixel consist of a red subpixel, a green subpixel, a blue subpixel, and a white subpixel.

21. The method of claim 20, wherein said selecting the switching state is performed with use of color bits provided to the color decoder, wherein the color bits uniquely identifies the switching state from four preset possible states and the bit length of the color bits is two, and wherein the step of providing further comprises:

connecting to at least one bias voltage, color data outputs which are not being used for providing to the pixel the color data for the active primary color subpixels.

22. The method of claim 13 further comprising:

receiving the stored color data and performing digital to analog conversion of the color data to generate analog color data using decoders, the number of decoders corresponding to a preset maximum number of active primary color subpixels of a pixel which is less than the number of primary color subpixels of the pixel, wherein receiving by the color decoder the color data comprises receiving by the color decoder the analog color data.

23. The method of claim 22, wherein the receiving by the color decoder of the analog color data from the decoders is via buffers, the method further comprising:

receiving by buffers the analog color data from the decoders, the number of buffers corresponding to the number of decoders.

24. The method of claim 13, further comprising:

storing the color data in a switch register.

* * * * *